United States Patent [19]

Drury

[11] Patent Number: 4,722,388

[45] Date of Patent: Feb. 2, 1988

[54] HEAT EXCHANGER

[76] Inventor: Chauncey R. Drury, 322 Ring Rd., Louisville, Ky. 40207

[21] Appl. No.: 904,923

[22] Filed: Sep. 8, 1986

[51] Int. Cl.[4] ..... F28D 7/02; F28F 1/14

[52] U.S. Cl. ..... 165/164; 165/183

[58] Field of Search ..... 165/183, 171, 164

[56] References Cited

U.S. PATENT DOCUMENTS

| | | | |
|---|---|---|---|
| 596,330 | 12/1897 | Maiche | 165/164 |
| 1,920,800 | 8/1933 | McCausland | 165/183 X |
| 1,961,070 | 5/1934 | Murphy | 165/171 X |
| 2,751,199 | 6/1956 | Williams | 165/183 X |
| 3,224,503 | 12/1965 | Komanz | 165/183 X |
| 3,380,518 | 4/1968 | Canteloobe et al. | 165/171 |
| 3,460,613 | 8/1969 | Kritzer | 165/183 |
| 3,656,547 | 4/1972 | Beach | 165/183 X |

*Primary Examiner*—Albert W. Davis, Jr.
*Assistant Examiner*—Richard R. Cole
*Attorney, Agent, or Firm*—Glenn B. Morse

[57] ABSTRACT

A heat exchanger has a primary circuit formed by a serpentine tube with parallel sections spaced to receive open ended tubes preferably of the same diameter between and around the primary tube sections in the natural arrangement of six about one. A secondary fluid may pass through these open-ended tubes in lengthwise manner and over the return bends of the primary circuit, lengthening the distance for contact and enhancing heat transfer. This arrangement permits a more compact heat exchanger and greater utilization of heat transfer surfaces. A pair of the exchangers can be operated as evaporators in series in alternating sequence for continuous defrosting.

5 Claims, 4 Drawing Figures

HEAT EXCHANGER

BACKGROUND OF THE INVENTION

The general function of a heat exchanger, as the term is commonly understood, is to transfer heat from one fluid medium to another. The fluids may be liquid or gas, or a combination of these. Heat exchanger applications include radiators, convectors, coolers, heaters, evaporators, and condensers. This list is by no means exhaustive. The configuration of heat exchangers generally has developed along two lines, liquid to liquid and secondly, liquid to gas or air. Considering the latter, liquid to air, or vice versa, the flowing liquid medium is usually within the metal conduits, and the exterior surface of the conduit has been maximized for greater exposure to the air or gas fluid.

The present state of the art most generally accepts the extension or increase of the outer surface of the conduit containing the primary liquid by mechanically changing its contour, or by the attachment of additional surfaces to it. Additionally, it is well established that the velocity of movement of either or both fluids changes the rate of heat transfer, in relationship already established. In the application of heat exchangers used as evaporators and condensers, loss of optimum performance is encountered when any surface is covered by frost, or foreign material. Frosting, or the build-up of ice crystals, can cause an evaporator to become ineffective. Foreign material can render a condenser inefficient. It is difficult to maintain efficiency of a refrigeration system that cannot be kept free of frost accumulation in excessive amounts, or a condenser that is not kept open to the induced air current.

The general pattern for construction of heat transfer devices where the primary fluid is a liquid, and the secondary fluid is air, requires the air movement be perpendicular to the conduits containing the liquids, necessitating air movement over the largest dimension of the exchanger.

SUMMARY OF THE INVENTION

A heat exchanger is formed by parallel sections of a serpentine tube, each of these sections being surrounded by open-ended tubes preferably of the same outside diameter as the serpentine tube. One fluid medium is passed through the serpentine tube, and the second fluid medium is passed through the open-ended tubes and the spaces between them via manifolds, or plenums, at least at one end of the assembly. A pair of the resulting heat exchangers, due to their size and air-flow requirements, may be used in place of a single evaporator so that one may be actively refrigerating while the other is being defrosted by condenser gases.

DESCRIPTION OF THE PREFERRED EMBODIMENTS

Figure 1:
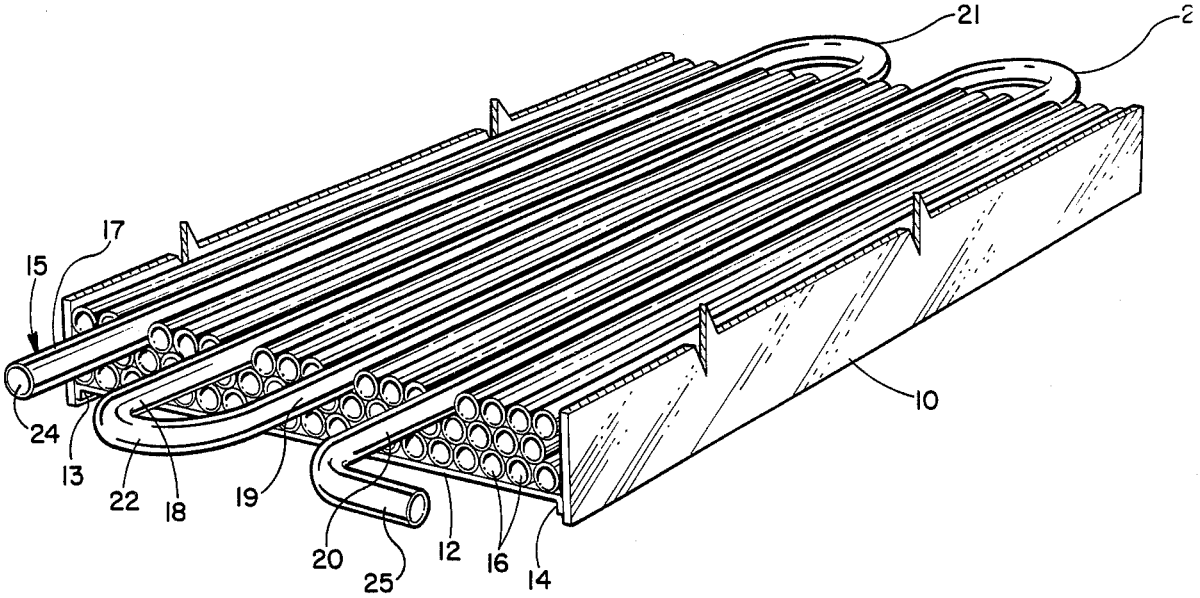
FIG. 1 is a perspective sectional view on the plane 1—1 of FIG. 2, showing a coplanar serpentine tube arrangement.
Figure 2:
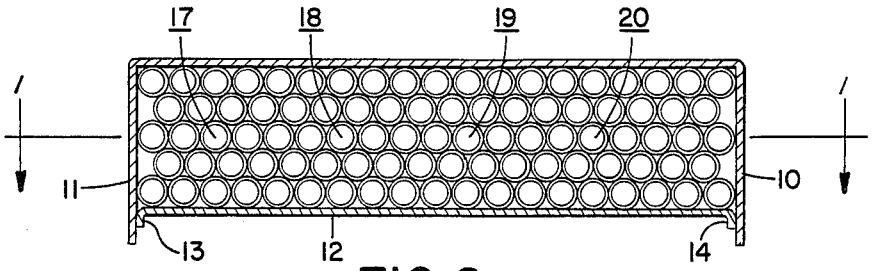
FIG. 2 is a transverse section through a heat exchanger constructed as shown in FIG. 1.

Referring to FIGS. 1 and 2, a housing generally indicated at 10 is formed by the channel-shaped member 11 and the closure plate 12. These are secured together by soldering or welding at the flanges 13 and 14 of the plate 12. The resulting housing is open-ended, and forms a container for the primary circuit conduit 15 and the secondary circuit conduits 16. The primary conduit 15 is a continuous serpentine tube having the straight sections 17–20 interconnected by the recurved portions 21–23. The ends of the serpentine tube shown at 24 and 25 are shaped according to preference for interconnection with other components of the circuit which includes the heat exchanger. The outside diameters of the primary and secondary tubes are preferably the same, resulting in a compact nesting of these components as shown in FIG. 2, in which each tube maintains physical contact with all of the tubes surrounding it. The assembly of the unit is as simple as placing a handful of tubes in a box. The first two layers of the open-ended tubes 16 are placed in the channel portion 11 of the housing (in a position inverted from that shown in FIGS. 1 and 2), followed by laying the serpentine tube 15 in place. The remainder of the open-ended tubes is then added, followed by the placement and securing of the closure plate 12. Normally, air is expected to circulate within the open-ended tubes 16 and through the spaces between them. Such flow can be induced either by a vertical position of the assembly (and the resulting convection effect), or a forced draft can be established by the use of appropriate manifolds or plenums at the opposite ends of the heat exchanger.

In FIGS. 1 and 2, the serpentine tube 15 can be regarded as coplanar. It should be noted that each of the parallel sections of this tube is surrounded by an inner sub-group of tubes in contact with each other and with the particular sections. All of these tubes and sections will normally be of metal, having a relatively high rate of heat conductivity. The contact resulting from the closely-packed arrangement due to the common outside diameter can be augmented by the presence of a meniscus formed by a liquid or semi-liquid material, or by the use of adhesives which do not interfere with the open continuity of the tubes. It is also highly significant that a tendency to form condensation or frost will itself provide the necessary meniscus to augment the heat transfer characteristics between the tubes. Relatively hot liquid flowing through the tube 15 is thus able to lose its heat through the walls of the tube 15, and from there to the walls of the surrounding group of tubes through the high conductivity characteristic of the metal. Large metal surfaces are thus exposed for the flow of air within the open-ended tubes 16, and in the spaces between them, for the transfer of this heat to the secondary heat-exchange medium. In addition to the group of tubes immediately surrounding each section, an outer group is also present in physical contact with each of the inner group. The relatively high intensity heat is thus dispersed out through a series of tubes in sequence, producing a temperature-transfer gradient that can be adapted to the particular needs of the heat exchanger. The transfer to the outer group of tubes is also facilitated by the presence of any material that can "wet" the metal contacting surfaces, so that line contact becomes a contact along a path of significant width.

Figure 3:
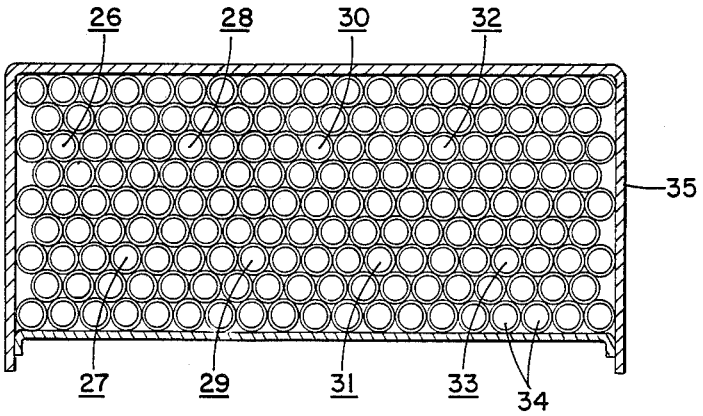
FIG. 3 is a transverse section through a modified form of the invention, and illustrating a serpentine tube having sections in spaced planes.

Referring to FIG. 3, a modified form of the invention has the parallel sections of the primary conduit indicated at 26–33, which are in two spaced planes. These are surrounded by open-ended tubes 34 as previously described. The housing 35 is similar in construction to housing 10; however, the housing may be eliminated entirely, since the tubes may be held together by adhesive meniscuses. The outside cross-section of the bundle may be round, curved, square or any shape that will permit these primary and secondary tubes to lie in their natural configuration of six-about one.

Figure 4:
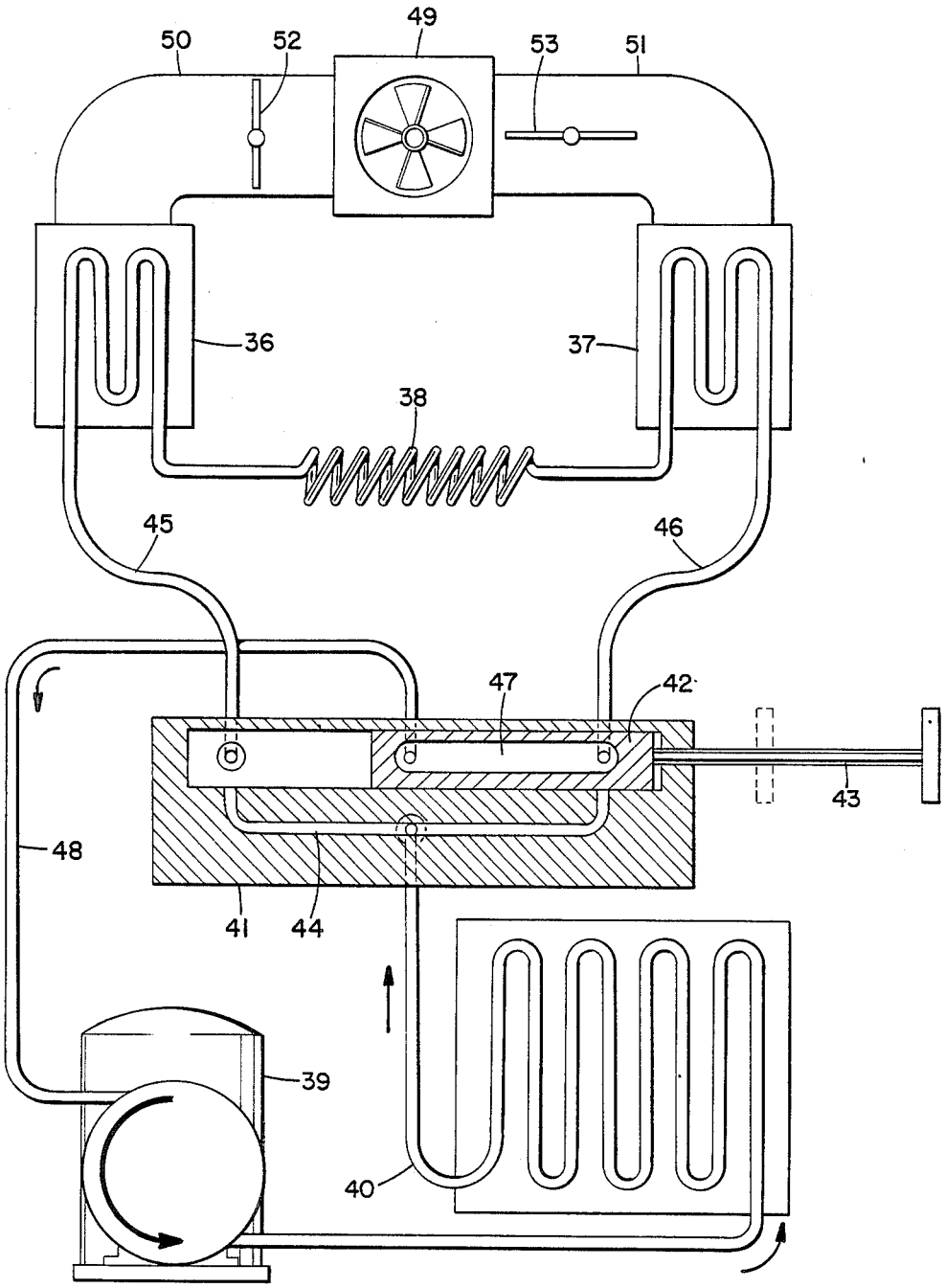
FIG. 4 is a schematic view showing an arrangement of heat exchangers functioning as evaporators operating in reverseable sequence.

Referring to FIG. 4, a schematic arrangement illustrates the incorporation of a pair of heat exchangers which may be constructed as shown in FIGS. 1–3 in an arrangement where they function as evaporators in a cooling system with a continuous defrosting feature. The evaporators 36 and 37 are interconnected by the capillary metering tube 38. A compressor 39 delivers compressed gas to the condenser 40, the output of which goes to the reversing valve generally indicated at 41. The slide member 42 of this valve is positioned by the shaft 43, which may be controlled by temperature-sensing equipment associated with the evaporators 36 and 37. In the illustrated position of the slide member 42, the output of the condenser 40 proceeds through the passage 44 to the evaporator 36 via the conduit 45. The liquid or liquid-gas mixture from the condenser 40 will contain sufficient heat, so long as air over the condenser is above 32 degrees F., to defrost evaporator 36 which is in effect, a part of the condenser. The flow proceeds out through the metering line 38, into the evaporator 37, where the reduction in pressure induces the principal cooling effect. The gas then proceeds through the line 46 back to the valve 41, where it continues through the passage 47 in the slide member 42, and thus is placed in communication with the return line 48 leading back to the compressor 39. Shifting of the slide member 42 to the left extreme of its freedom of movement will reverse this flow. Such reversal will raise the temperature in the evaporator 37 sufficiently to remove any accumulations of frost which might have resulted from its cooling mode. The induced draft system established by the blower 49 delivers a flow of air as the secondary circuit through the ducts 50 and 51 under the control of the dampers 52 and 53. These dampers are operated in a relationship with the mode in which the particular evaporators are functioning, so that the draft is present while the particular evaporator is in the cooling mode, and shut off when it is not.

What is claimed is:

1. A heat exchanger having primary and secondary conduits in heat-exchanging relationship, wherein the improvements comprises:

at leat one serpentine tube having parallel sections connected by reverse bends, said serpentine tube constituting one of said conduits;

a group of open-ended tubes disposed adjacent to the said parallel sections, said open-ended tubes constituting the other of said conduits, and forming a continuous mass of contacting tubes extending between and surrounding said serpentine tube sections; and means securing said mass of tubes together to form a predetermined cross-section of the entirety of said mass of open-ended tubes and tube sections.

2. A heat exchanger as defined in claim 1, wherein said open-ended tubes closely surround said sections in normally contacting relationship.

3. A heat exchanger as defined in claim 2, wherein said tubes have the same diameter.

4. A heat exchanger as defined in claim 1, wherein said serpentine tube has the axes of said sections disposed in spaced planes.

5. A heat exchanger as defined in claim 1, wherein said sections are surrounded by an inner sub-group of open-ended tubes immediately adjacent to said sections, and by an outer sub-group of open-ended tubes surrounding said inner sub-group.

* * * * *